US008723736B2

(12) United States Patent
Park et al.

(10) Patent No.: US 8,723,736 B2
(45) Date of Patent: May 13, 2014

(54) MULTI BAND ANTENNA WITH MULTI LAYERS

(75) Inventors: Chul Woo Park, Gyeonggi-do (KR); Yong Sup Kim, Gyeonggi-do (KR); Youn Goo Yang, Gyeonggi-do (KR)

(73) Assignees: Samsung Electronics Co., Ltd (KR); Sungkyunkwan University Foundation for Corporate Collaboration (KR)

( * ) Notice: Subject to any disclaimer, the term of this patent is extended or adjusted under 35 U.S.C. 154(b) by 210 days.

(21) Appl. No.: 13/312,489

(22) Filed: Dec. 6, 2011

(65) Prior Publication Data

US 2012/0139796 A1 Jun. 7, 2012

Related U.S. Application Data

(60) Provisional application No. 61/420,076, filed on Dec. 6, 2010.

(30) Foreign Application Priority Data

Nov. 29, 2011 (KR) ..... 10-2011-0125968

(51) Int. Cl.
*H01Q 1/38* (2006.01)

(52) U.S. Cl.
USPC ..... 343/700 MS

(58) Field of Classification Search
USPC ..... 343/700 MS
See application file for complete search history.

(56) References Cited

U.S. PATENT DOCUMENTS 5,210,542 A * 5/1993 Pett et al. ..... 343/700 MS

* cited by examiner

*Primary Examiner* — Hoang V Nguyen
(74) *Attorney, Agent, or Firm* — The Farrell Law Firm, P.C.

(57) ABSTRACT

A multi-layer multi band antenna is provided. Because the antenna carrier has a structure stacked in a plurality of layers having different dielectric constants, the antenna maintains a small size yet has an improved radiation performance in a desired bandwidth.

7 Claims, 9 Drawing Sheets

MULTI BAND ANTENNA WITH MULTI LAYERS

PRIORITY

This application claims priority under 35 U.S.C. §120 to U.S. Provisional Patent Application No. 61/420,076, which was filed in the U.S. Patent and Trademark Office on Dec. 6, 2010, and to an application filed in the Korean Intellectual Property Office on Nov. 29, 2011, and assigned Serial No. 10-2011-0125968, the contents of each of which are incorporated herein by reference.

BACKGROUND OF THE INVENTION

1. Field of the Invention

The present invention relates generally to an antenna, and more particularly, to a multi band antenna with multi layers having a stacked structure.

2. Description of the Related Art

Wireless communication systems generally provide various wireless communication services such as multimedia as well as voice. Each wireless communication service is provided through different frequency bands, so that in a wireless communication system, a multi band antenna is utilized in a communication terminal.

A multi band antenna apparatus has a plurality of antenna elements, each of which operating in different frequency bands such that the communication terminal can use various wireless communication services.

Conventionally, in order to provide maximum performance in limited space, one carrier is inserted to correspond to a device shape, and an antenna pattern is formed in the carrier. By bending a pattern form on one carrier, a multi band antenna is embodied and thus a wider area is necessary, and only an upper and side surface of the carrier is used. Thereby, the antenna size increases, which in turn increases the size of the mobile terminal.

Further, in order to embody a small-sized antenna, when the volume of the antenna is reduced, the bandwidth is narrowed and thus antenna performance is deteriorated.

SUMMARY OF THE INVENTION

The present invention has been made in view of the above problems, and provides a multi band antenna with multi layers having a stacked structure.

Specifically, the present invention provides a multi-layer multi band antenna that reduces antenna size but does not reduce a bandwidth, by forming a structure stacked in a plurality of layers having different dielectric constants.

In accordance with an aspect of the present invention, a multi band antenna with multi layers includes a power supply unit for supplying power, a lower substrate for contacting with the power supply unit and having a first antenna pattern, an intermediate substrate stacked to separate from the lower substrate and having empty space of a shape therein and having an antenna bandwidth changing according to a thickness, and an upper substrate stacked to separate from the intermediate substrate and having a second antenna pattern.

BRIEF DESCRIPTION OF THE DRAWINGS

The objects, features and advantages of the present invention will be more apparent from the following detailed description in conjunction with the accompanying drawings, in which.

DETAILED DESCRIPTION OF EMBODIMENTS OF THE PRESENT INVENTION

Figure 1:
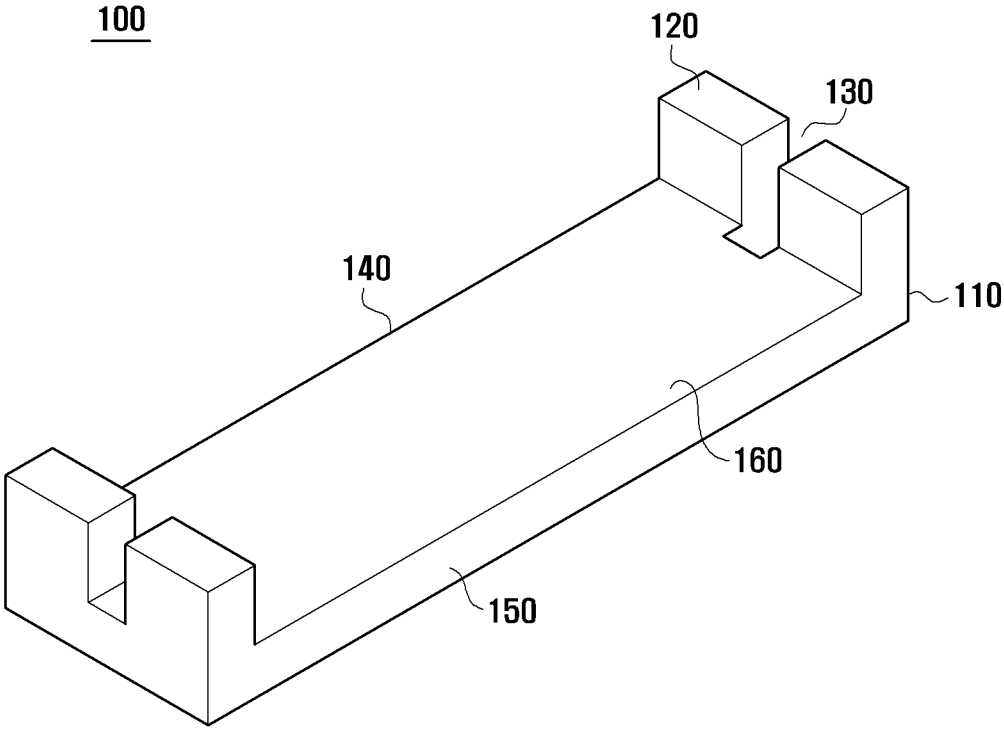
FIG. 1 illustrates a lower substrate of a multi-layer multi band antenna according to an embodiment of the present invention.

Hereinafter, embodiments of the present invention are described in detail with reference to the accompanying drawings. The same reference numbers are used throughout the drawings to refer to the same or like parts. The views in the drawings are schematic, and are not intended to be to scale or correctly proportioned. Detailed descriptions of well-known functions and structures incorporated herein may be omitted for the sake of clarity and conciseness.

Figure 2:
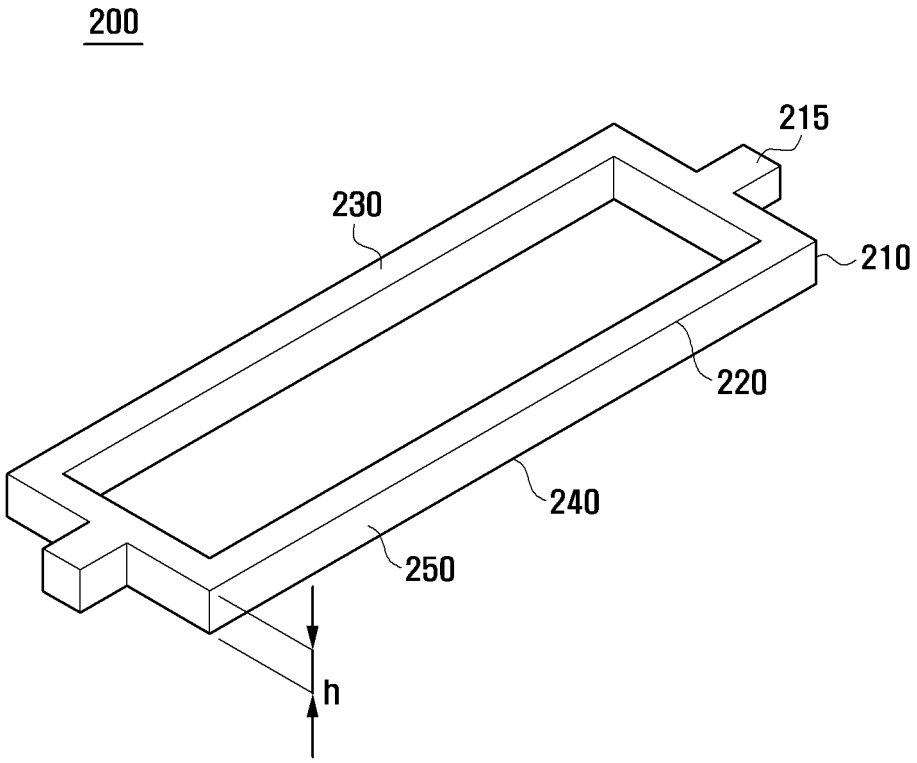
FIG. 2 illustrates an intermediate substrate of a multi-layer multi band antenna according to an embodiment of the present invention.
Figure 3:
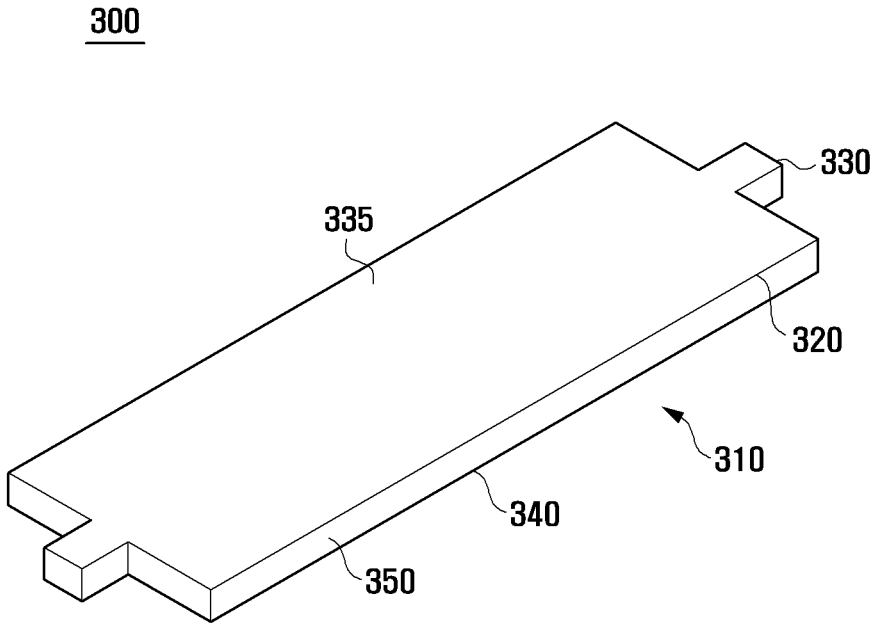
FIG. 3 illustrates an upper substrate of a multi-layer multi band antenna according to an embodiment of the present invention.

FIGS. 1 to 3 illustrate each substrate constituting a multi-layer multi band antenna according to an embodiment of the present invention. Specifically, FIG. 1 illustrates a lower substrate 100 constituting a multiple band stacked antenna, FIG. 2 illustrates an intermediate substrate 200 constituting a multi band antenna with multi layers, and FIG. 3 illustrates an upper substrate 300 constituting a multi band antenna with multi layers.

In the present embodiment, a multi band antenna with multi layers is formed with an Acrylonitrile Butadiene Styrene (ABS) resin; however, a material of the multi band antenna with multi layers is not limited thereto. A relative permittivity of the ABS resin is 2.3.

Referring to FIG. 1, a lower substrate 100 of a multi band antenna with multi layers includes a lower substrate body 110 and a lower substrate layer 140.

The lower substrate body 110, provided as a lower support body of a multi-layer multi band antenna, has a flat plate structure formed with at least four corners and further includes a protruded portion 120 and a concave portion 130 for coupling to an intermediate substrate 200 and an upper substrate 300 at each corner. The lower substrate body 110 is made of a dielectric substance and includes a power supply area at one surface.

At the lower substrate layer 140, a first antenna pattern for transmitting and receiving a signal of a predetermined frequency band in the multi band antenna with multi layers is disposed. The antenna pattern, which may be a copper strip of 1.5 mm, transmits a signal by resonating in a frequency band. The antenna pattern may be disposed to be either in contact with or separate from the lower substrate layer 140.

Referring to FIG. 2, the intermediate substrate 200 of a multi band antenna with multi layers includes an intermediate substrate body 210 and an intermediate substrate layer 220.

The intermediate substrate 200 is stacked to be either separate from the upper side of the lower substrate 100 or in contact with the lower substrate 100.

The intermediate substrate body 210, provided as an intermediate support body of the multi-layer multi band antenna, has a flat plate structure formed with at least four corners and further includes a protruded portion 215 for coupling the lower substrate 100 and the upper substrate 300 at one surface.

The intermediate substrate body 210 is made of a dielectric substance, and has an interior with empty space. FIG. 2 illustrates empty space of a rectangular shape. The empty space may be filled with a material having a dielectric constant different from that of a material of the lower substrate 100 and the upper substrate 300, or an antenna pattern extended from the lower substrate 100. In the present embodiment, air fills the empty space within the intermediate substrate 200. A bandwidth of the multi band antenna with multi layers is changed according to a thickness h of the intermediate substrate body 210 having air therein.

In the prior art, when an occupying bulk of antennas decreases by stacking antennas, a bandwidth also reduces and thus antenna performance is deteriorated. However, in the present embodiment, the intermediate substrate 200 having empty space filled with air is inserted into the multi band antenna with multi layers, and adjusting the thickness of the intermediate substrate 200 solves the prior art problem of the narrowing of the antenna bandwidth.

The intermediate substrate layer 220 is divided into a top surface 230 and a bottom surface 240, and the top surface 230 contacts with the upper substrate 300, and the bottom surface 240 contacts with the lower substrate 100. In the present embodiment, an antenna pattern may be disposed at the intermediate substrate layer 220.

Referring to FIG. 3, the upper substrate 300 includes an upper substrate body 310, and an upper substrate layer 320.

The upper substrate 300 is stacked to be either separate from the top surface 230 of the intermediate substrate 200 or in contact with the intermediate substrate 200.

The upper substrate body 310 is provided as an upper support body of a multi-layer multi band antenna. The upper substrate body 310 has a flat plate structure formed with at least four corners and further includes a protruded portion 330 for coupling to the intermediate substrate 200 at one surface. The upper substrate body 310 is made of a dielectric substance.

The upper substrate layer 320 is formed with a top surface 335 and a bottom surface 340, and a second antenna pattern for transmitting and receiving a signal of a predetermined frequency band in the multi-layer multi band antenna is disposed at either the top or bottom surface. The antenna pattern may be a copper strip of 1.5 mm and transmits a signal by resonating in a predetermined frequency band. The antenna pattern is disposed to be either in contact with the upper substrate layer 320 or separate from the bottom side. When the antenna pattern is disposed separate from the bottom side, the antenna pattern may be disposed at internal space of the intermediate substrate 200.

Figure 4:
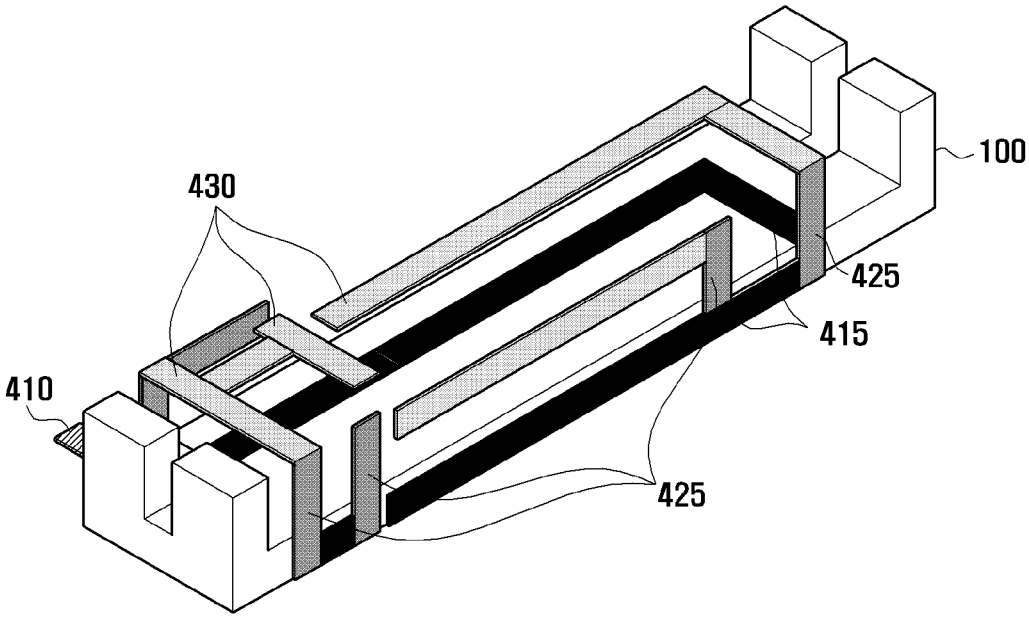
FIG. 4 illustrates a disposition of an antenna pattern and a lower substrate of a multi-layer multi band antenna according to an embodiment of the present invention.
Figure 5:
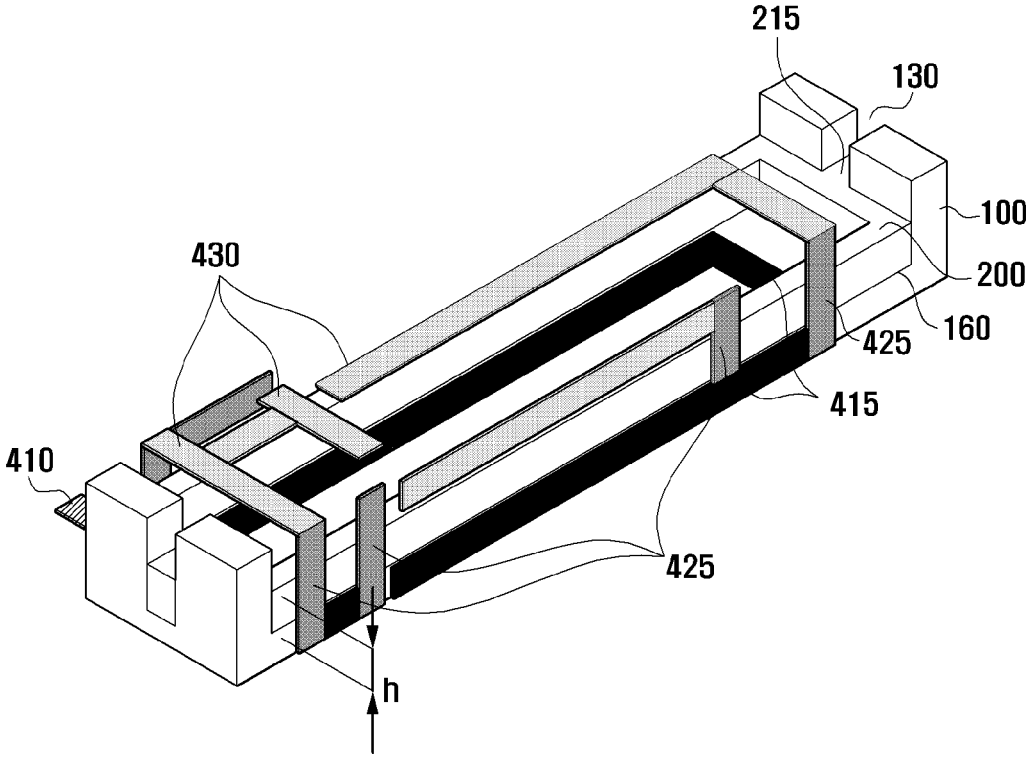
FIG. 5 illustrates a disposition of an antenna pattern and a stacked state of a lower substrate and an intermediate substrate of a multi-layer multi band antenna according to an embodiment of the present invention.
Figure 6:
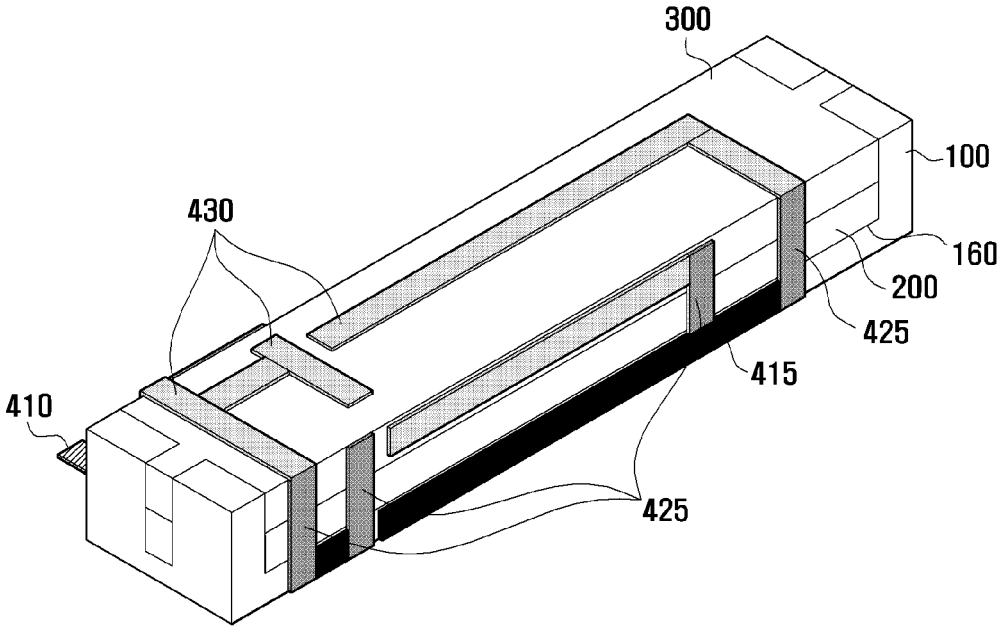
FIG. 6 illustrates a disposition of an antenna pattern and a sequential stacked state of a lower substrate, an intermediate substrate, and an upper substrate of a multi-layer multi band antenna according to an embodiment of the present invention.

FIGS. 4 to 6 illustrate a state in which an antenna pattern is disposed at each layer constituting a multi-layer multi band antenna according to an embodiment of the present invention.

FIG. 4 illustrates a disposition of an antenna pattern and the lower substrate 100 of a multi band antenna with multi layers according to an embodiment of the present invention.

First, the lower substrate 100 is connected to a power supply unit 410.

The power supply unit 410, which supplies power in the multi-layer multi band antenna, supplies a current by contacting with an antenna pattern. The power supply unit 410 is formed in a power supply area of the lower substrate 100, by patterning a metal material at a surface of the lower substrate 100.

FIG. 4 illustrates both the lower substrate 100 and an antenna pattern for resonating the multi band antenna with multi layers. The antenna pattern is disposed over the entire surface of the lower substrate 100, the intermediate substrate 200, and the upper substrate 300.

A first antenna pattern 415 is initially disposed at the lower substrate 100. The antenna pattern may be disposed through a top surface, a bottom surface, and a side surface of the lower substrate 100.

A second antenna pattern 425 connects each antenna pattern disposed at the lower substrate 100, the intermediate substrate 200, and the upper substrate 300. The second antenna pattern 425 is disposed at a side surface 150, 250, 350 of each substrate and connects an antenna pattern disposed at each layer.

A third antenna pattern 430 is disposed at the upper substrate 300. The antenna pattern may be disposed through a top surface, a bottom surface, and a side surface of the upper substrate 300.

FIG. 5 illustrates a disposition of an antenna pattern and a stacked state of the lower substrate 100 and the intermediate substrate 200 of a multi-layer multi band antenna according to an embodiment of the present invention.

Referring to FIG. 5, the intermediate substrate 200 is stacked at the upper side 160 of the lower substrate 100. In this case, the lower substrate 100 and the intermediate substrate 200 are separated, and FIG. 5 illustrates an example in which the lower substrate 100 and the intermediate substrate 200 contact each other. When the intermediate substrate 200 and the lower substrate 100 are stacked, a concave portion 130 of the lower substrate 100 and a protruded portion 215 of the intermediate substrate 200 may be stacked.

As shown in FIG. 5, empty space of a predetermined shape is formed within the intermediate substrate 200. In the present embodiment, air may be filled in the empty space. Further, a bandwidth of the multi band antenna with multi layers is changed according to a thickness h of the intermediate substrate body 210 having air therein.

FIG. 6 illustrates a disposition of an antenna pattern and a sequential stacked state of the lower substrate 100, the intermediate substrate 200, and the upper substrate 300 of a multi-layer multi band antenna according to an embodiment of the present invention.

Referring to FIG. 6, the intermediate substrate 200 is stacked at the upper side 160 of the lower substrate 100, and the upper substrate 300 is stacked on the intermediate substrate 200. Although the substrates of each layer may be separated, FIG. 6 illustrates an example in which substrates of each layer contact each other.

The upper substrate 300 is stacked on the intermediate substrate 200, and internal space of the intermediate substrate 200 is blocked by the upper substrate 300. Thereby, an intermediate portion of the multi-layer multi band antenna has empty space, and the antenna is formed as a carrier in which a plurality of layers are stacked.

As described above, a bandwidth of the multi-layer multi band antenna is determined according to a height h of the intermediate substrate 200. Even if a height h of the intermediate substrate 200 changes, the overall height of the antenna does not change. That is, if a height h of the intermediate substrate 200 is extended, a height of the lower substrate 100 and the upper substrate 300 is shortened. If a height h of the intermediate substrate 200 is shortened, a height of the lower substrate 100 and the upper substrate 300 is extended.

Hereinafter, a performance of the multi-layer multi band antenna according to the present invention is described with reference to Table 1 and FIGS. 8 and 9.

First, a relative permittivity of each substrate constituting the multi-layer multi band antenna is 2.3, and a size of each substrate is 40*9 $mm^2$. Heights of the lower substrate 100, the intermediate substrate 200, and the upper substrate 300 are 2 mm, 1.85 mm, and 1.85 mm, respectively. A volume of empty space within the intermediate substrate 200 is 32*5*1.85 $mm^3$.

A width of the antenna pattern is 1.5 mm, and an overall size of the antenna is 30*9*5.7 $mm^3$ (1.54 cc).

Figure 7:
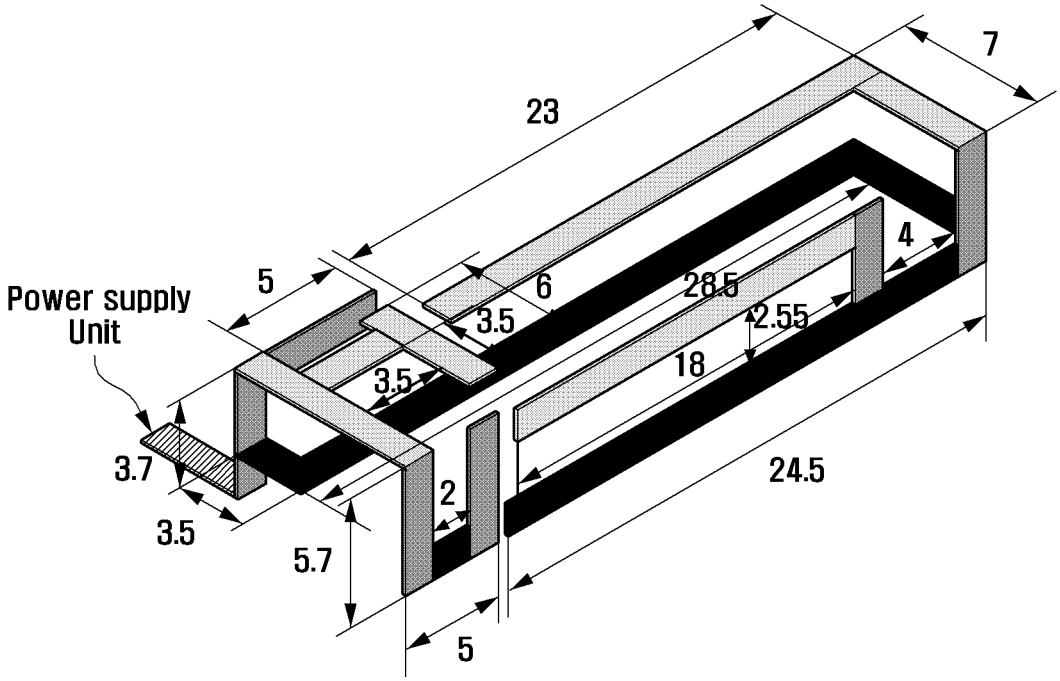
FIG. 7 illustrates a shape and size of an antenna pattern to be disposed in a multi-layer multi band antenna according to an embodiment of the present invention.

FIG. 7 illustrates a shape and size of an antenna pattern to be disposed in a multi-layer multi band antenna according to an embodiment of the present invention. The antenna is mounted in a Printed Circuit Board (PCB) using an FR4 substrate having a thickness 1.2 mm, a relative permittivity 4.0, and a size 80*40 $mm^2$.

A radiation performance measured according to the above-described condition of the multi-layer multi band antenna of FIG. 7 is shown in Table 1.

TABLE 1

| Bands | Ave. Efficiency(%) | Ave. Gain(dBi) |
|---|---|---|
| GSM900 | 41.68 | −3.80 |
| DCS1800 | 51.74 | −2.87 |
| PCS1900 | 53.29 | −2.77 |
| WCDMA | 59.14 | −2.31 |

Because a radiation performance of a general intenna is 30% to 40% in a low frequency band and is 50% or more in a high frequency band, it is evident that the radiation performance of the multi-layer multi band antenna according to the present invention is excellent.

Figure 8:
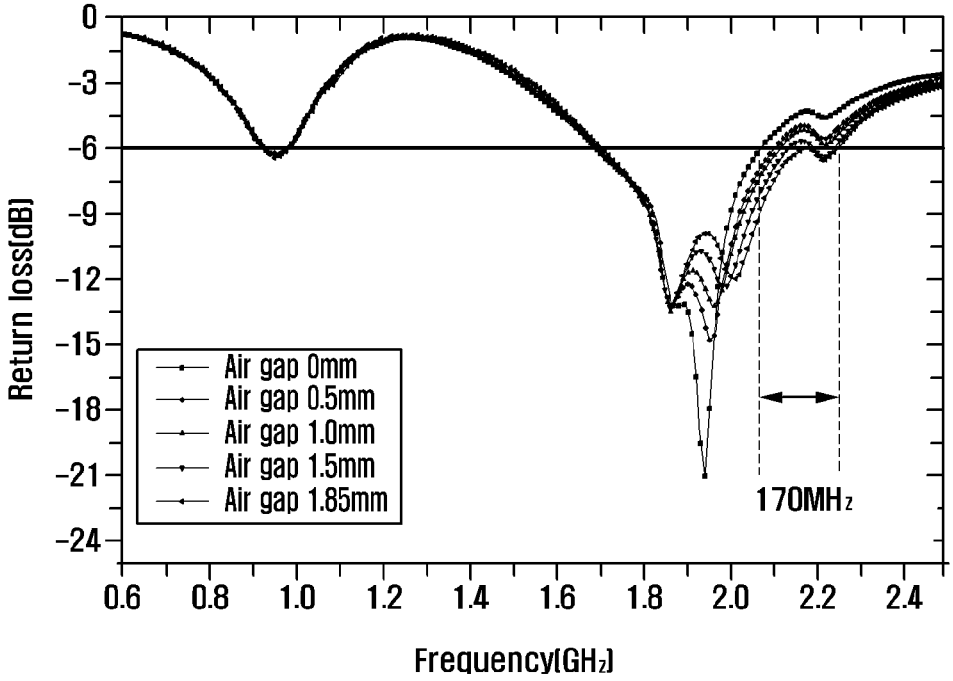
FIG. 8 illustrates a bandwidth change of an antenna according to a height change of an intermediate substrate according to an embodiment of the present invention.

FIG. 8 illustrates a bandwidth change of an antenna according to a height change of the intermediate substrate 200 according to an embodiment of the present invention.

In general, an antenna can perform a function when a return loss is −6 dB or less. In FIG. 8, when a height (i.e., a thickness of an air-gap) of the intermediate substrate 200 increases, it can be determined that a bandwidth is widened.

Figure 9:
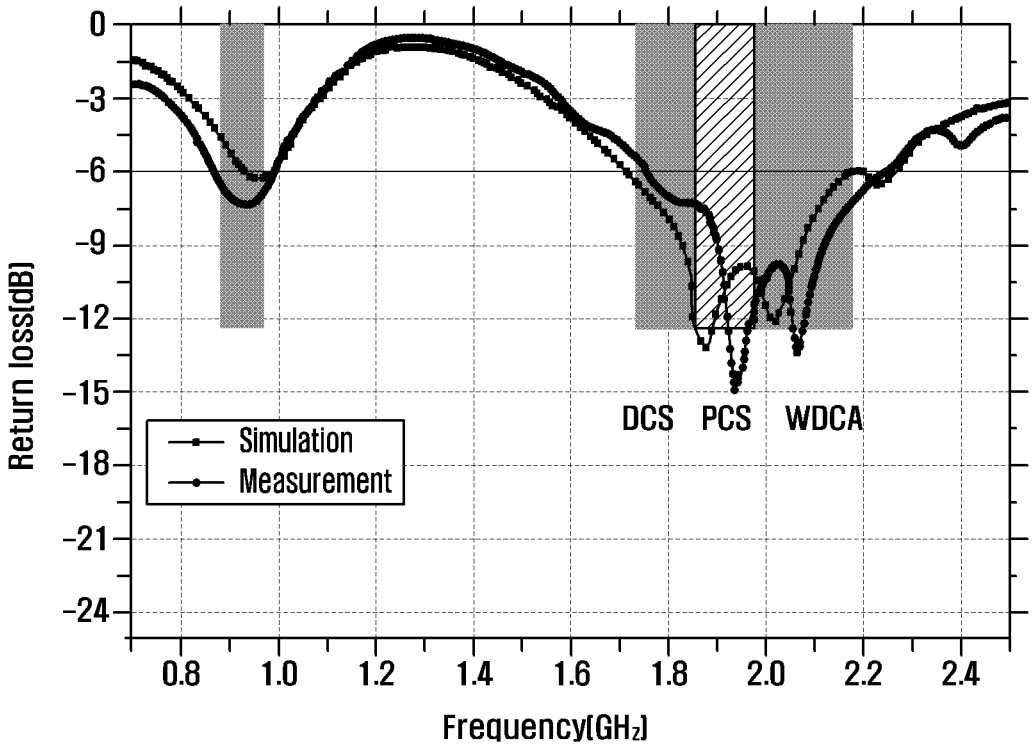
FIG. 9 illustrates a performance on a frequency basis of a multi-layer multi band antenna according to an embodiment of the present invention.

FIG. 9 illustrates a performance on a frequency basis of a multi-layer multi band antenna according to an embodiment of the present invention.

Referring to FIG. 9, when sequentially stacking a plurality of substrate layers and injecting an air layer into an intermediate layer of the antenna, in order for the substrate to have different dielectric constants, an effective antenna performance can be exhibited in Global System for Mobile Communications (GSM)900, Digital Cellular Services (DCS), Personal Communications Services (PCS), and Wideband Code Division Multiple Access (WCDMA) bands.

As described above, according to the present invention, because an antenna carrier has a structure stacked in a plurality of layers having different dielectric constants, an antenna can have a small size but exhibit an improved radiation performance in a desired bandwidth. Further, because the antenna pattern is enclosed by a dielectric substance, an electrical signal is shortened and thus the antenna pattern is relatively shortened.

Although embodiments of the present invention have been described in detail hereinabove, it should be clearly understood that many variations and modifications of the basic inventive concepts herein described, which may appear to those skilled in the art, will still fall within the spirit and scope of the embodiments of the present invention as defined in the appended claims.

What is claimed is:

1. A multi band antenna with multi layers comprising:

a power supply unit for supplying power;

a lower substrate for contacting with the power supply unit and having a first antenna pattern;

an intermediate substrate stacked to be separate from the lower substrate and having empty space therein and having an antenna bandwidth which changes according to a thickness of the intermediate substrate; and an upper substrate stacked to be separate from the intermediate substrate and having a second antenna pattern, wherein a thickness of the lower substrate and a thickness of the upper substrate are determined according to the thickness of the intermediate substrate.

2. The multi band antenna with multi layers of claim 1, wherein air is filled in an empty space of the intermediate substrate.

3. The multi band antenna with multi layers of claim 2, wherein as the thickness of the intermediate substrate filled with air increases, a bandwidth of the antenna is widened.

4. The multi band antenna with multi layers of claim 1, wherein dielectric constants of the lower substrate, the intermediate substrate, and the upper substrate are different.

5. The multi band antenna with multi layers of claim 1, wherein the first antenna pattern and the second antenna pattern are disposed in at least one of a top surface, a bottom surface, and a side surface of the lower substrate and the upper substrate, respectively.

6. The multi band antenna with multi layers of claim 1, wherein the first antenna pattern and the second antenna pattern are one antenna pattern connected to each other.

7. The multi band antenna with multi layers of claim 1, wherein the lower substrate, the intermediate substrate, and the upper substrate contact with each other.

* * * * *